United States Patent [19]

Ramakrishnan et al.

[11] Patent Number: 4,986,170

[45] Date of Patent: Jan. 22, 1991

[54] AIR HANDLING SYSTEM

[75] Inventors: Ramani Ramakrishnan, Toronto; Norman Ball, Ottawa, both of Canada

[73] Assignee: M & I Heat Transfer Products Ltd., Mississauga, Canada

[21] Appl. No.: 429,534

[22] Filed: Sep. 21, 1989

[51] Int. Cl.[5] ..... F24F 7/08

[52] U.S. Cl. ..... 98/33.1; 98/DIG. 10; 181/224

[58] Field of Search ..... 98/33.1, 39.1, 40.01, 98/DIG. 10, 1; 181/224, 264, 268

[56] References Cited

U.S. PATENT DOCUMENTS

| | | | |
|---|---|---|---|
| 1,825,103 | 9/1931 | Stacey, Jr. | 98/1 |
| 2,740,347 | 4/1956 | Caldwell | 98/39.1 X |
| 3,125,286 | 3/1964 | Sanders | 98/39.1 X |
| 3,283,694 | 11/1966 | Dean, Jr. . | |
| 3,422,888 | 1/1969 | Coleman et al. . | |
| 4,295,416 | 10/1981 | Gorchev et al. | 98/DIG. 10 X |
| 4,313,522 | 2/1982 | Gurchev et al. | 98/DIG. 10 X |
| 4,319,521 | 3/1982 | Gorchev et al. . | |
| 4,418,788 | 12/1983 | Gorchev et al. | 98/DIG. 10 X |
| 4,508,486 | 4/1985 | Tinker | 415/119 |
| 4,582,164 | 4/1986 | Schreiner | 181/224 |
| 4,660,676 | 4/1987 | Eustace | 181/224 |

FOREIGN PATENT DOCUMENTS

| | | | |
|---|---|---|---|
| 2822967 | 11/1979 | Fed. Rep. of Germany | 98/DIG. 10 |
| 3401210 | 7/1985 | Fed. Rep. of Germany | 181/224 |
| 57-101235 | 6/1982 | Japan | 98/DIG. 10 |
| 1423986 | 2/1976 | United Kingdom | 181/224 |

*Primary Examiner*—Harold Joyce

*Attorney, Agent, or Firm*—Moss, Barrigar & Oyen

[57] ABSTRACT

A branch take-off airflow device for use in an air distribution system that includes coaxial input and output ducts and one or more branch ducts having a status pressure regain section and a take-off section that has a central passageway and one or more take-off passageways. Each of the take-off passageways is generally rectangular in transverse cross-section and defined by inner and outer walls with the latter being a continuation of a wall defining the output opening of the regain section. The inner wall has a thick, rounded leading edge where the take-off passageway commences. In one preferred version, there is an elongate air flow defining member located centrally in the main passageway of both sections and extending in the axial direction. This member has a generally round, transverse cross-section with a maximum diameter equal to or less than the diameter of the hub of an adjacent axial fan.

9 Claims, 10 Drawing Sheets

AIR HANDLING SYSTEM

BACKGROUND TO THE INVENTION

This invention relates to air distribution systems, in particular apparatus for extracting air from a main supply duct to a branch duct.

It is well known to distribute air in a building from a main air supply duct to various branch ducts through openings in the wall of the main duct which enter into the branch ducts. The volume flow rate of air through the branch is determined to some extent by the static pressure in the main duct and the flow resistance of the branch. Because the branch opening is flush with the wall of the main duct in the commonly used distribution systems, the dynamic pressure of the air flow in the main duct does not assist the flow rate in the branch duct.

Attempts have been made to control or reduce the level of noise created by such air distribution systems. With the aforementioned configuration, the noise level at the start of the branch duct is generally the same as the noise level in the main duct, the noise being caused primarily by the air supply fan used in such systems. It is known to use a silencer at the exit of the fan in the main duct to reduce the noise level. Silencers have also been employed at the inlet to the main supply fan. In order that the silencer will not unduly affect the operation of the system, its use must result in a low pressure drop and its total open area must be sizable. Thus, the silencer must be relatively large. Because of this, known silencers can be costly and can require a large amount of space in the building.

U.S. Pat. No. 4,418,788, issued Dec. 6, 1983 to Mitco Corporation, describes a branch take-off and silencer for an air distribution system. The apparatus includes a static pressure regain section and a channel section adapted for coupling the input duct to an output duct and branch ducts. The inner surface of the wall of the regain section and that of the outer wall of the channel section form a continuous curve which results in smooth changes in air flow velocity in order to provide efficient conversion of velocity pressure to static pressure. A major difficulty with such an apparatus is that, due to the round cross-section of the take-off passageway, such an apparatus is difficult to manufacture, particularly if maximum efficiency is to be obtained. Also, aspects of this known design are not particularly helpful in reducing the noise level in the system or in the branch ducts.

U.S. Pat. No. 4,319,521, issued Mar. 16, 1982 to Mitco Corporation, describes an air distribution system that includes a mixing plenum for receiving and mixing outside and return air. There is an input flow concentrator, an integral silencer disposed within and coupled to the mixing plenum and this device is adapted to establish a substantially axially symmetrical flow path for air from the plenum to an output port. A fan is coupled to the output port to drive the air through the main duct for distribution. The path defining walls of the concentrator are lined with acoustically absorbent material.

It is an object of the present invention to provide an improved branch take-off air flow device for use in an air distribution system, which device is not unduly difficult to manufacture and which has improved sound attenuating capabilities.

It is a further object of the invention to provide a branch take-off air flow device particularly suited for use downstream of an axial fan having a central hub and a round fan outlet. This take-off device includes an elongate air flow defining member located centrally in the main air passageway and extending in the axial direction. The provision of this generally round member provides improved air flow characteristics to the branch take-off device and greater sound attenuation.

SUMMARY OF THE INVENTION

According to one aspect of the invention, a branch take-off air flow device for use in an air distribution system that includes coaxial input and output ducts and one or more branch ducts angularly offset from the input and output ducts has a static pressure regain section having an air passageway with an input port of a size substantially the same as the outlet of said input duct and an output opening. There is also a take-off section having a central passageway and one or more take-off passageways, the central passageway having an output port of a size substantially the same as an inlet of the output duct. Each of the take-off passageways is generally rectangular in transverse cross-section and is defined by inner and outer walls with the outer wall being a continuation of a wall defining the output opening of the regain section. The inner wall has a relatively thick, rounded leading edge where the take-off passageway commences. An elongate airflow defining member is located centrally in both the passageway of the regain section and the central passageway of the take-off section and extends in the axial direction. This member has a generally round, transverse cross-section, which is substantially uniform in said regain section, and has a maximum diameter equal to or less than its uniform diameter in the regain section. The airflow defining member extends axially past the rounded leading edge where the take-off passageway commences.

According to another aspect of the invention, a branch take-off air flow device is provided for use in an air distribution system downstream of an axial fan having a central hub and a fan housing with a round air outlet, the system including an output duct located downstream of the device and one or more branch ducts angularly offset from the center axis of the fan and the output duct. The device includes a static pressure regain section having an air passageway extending therethrough, this passageway having an inlet substantially the same in size as the round air outlet of the fan. There is also a take-off section including a central air passageway extending therethrough and one or more take-off passageways. The central passageway has an output port of a size substantially the same as an inlet of the output duct. An elongate air flow defining member is located centrally in both the passageway of the regain section and the central passageway of the take-off section and extends in the axial direction. The member has a generally round transverse cross-section with a maximum diameter equal to or less than the diameter of the hub of the fan. This member is generally cylindrical in the regain section and extends axially past an inlet or inlets of the one or more take-off passageways.

Preferably the air flow defining member has a metal exterior skin that is perforated with numerous holes distributed over its surface and is filled with sound absorbing material surrounded by this skin.

According to a further aspect of the invention, a branch take-off air flow device is provided for use in an air distribution system that includes co-axial input and output ducts and one or more branch ducts angularly offset from the input and output ducts. The device has a static pressure regain section and a take-off section with both sections having a main air passageway extending therethrough and adapted to conduct air between the input and output ducts. The take-off section has one or more take-off passageways which are generally rectangular in transverse cross-section and are adapted to conduct air to the branch ducts. Each of these passageways is defined by inner and outer walls with the outer wall being a continuation of a wall forming the regain section. Each take-out passageway has a relatively long, straight first portion and an outwardly curving second portion downstream from the first portion. The second portion has a gradually increasing transverse cross-sectional area in the direction of air flow.

Preferably the inner wall of the take-off section is filled with sound absorbing material that extends to a leading edge of the wall located where the take-off passageway commences.

Further features and advantages of the present branch take-off air flow device will become apparent from the following detailed description taken in conjunction with the accompanying drawings.

DETAILED DESCRIPTION OF PREFERRED EMBODIMENTS

Figure 1:
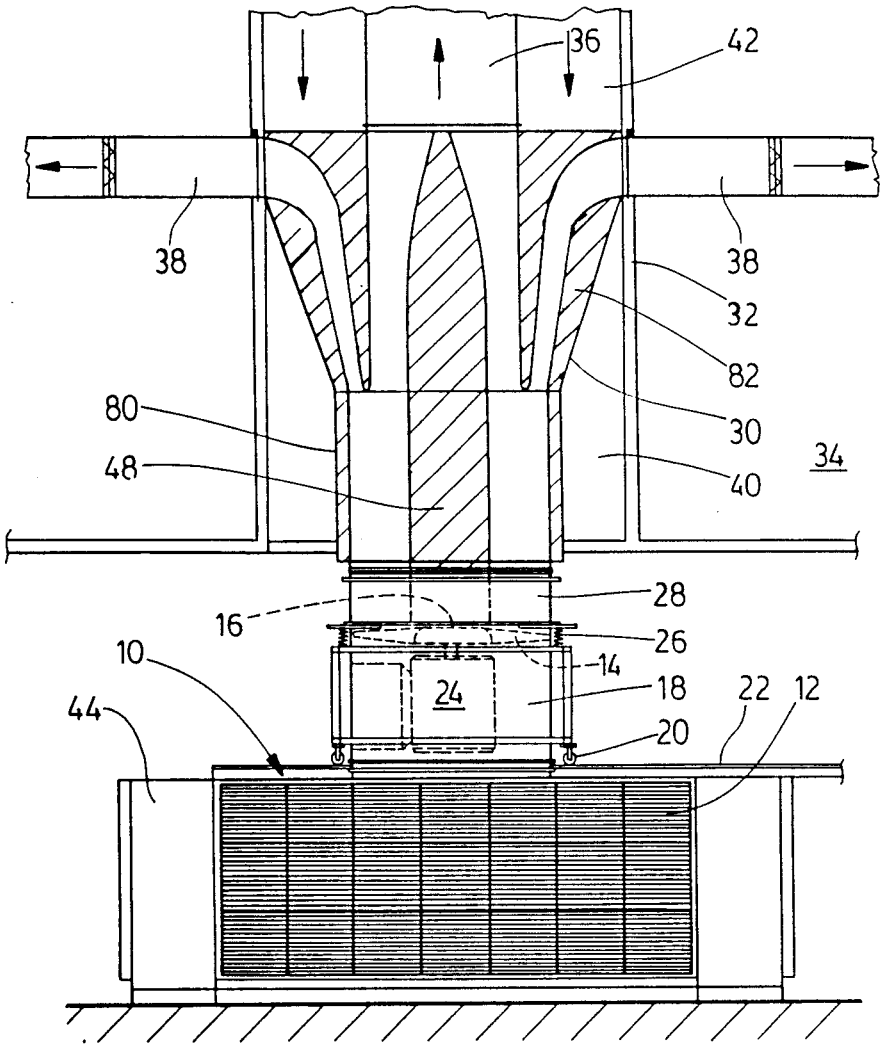
FIG. 1 is a front elevation, partly in cross-section, illustrating a vertical up-blast air distribution system including a branch take-off air flow device constructed in accordance with the invention.
Figure 2:
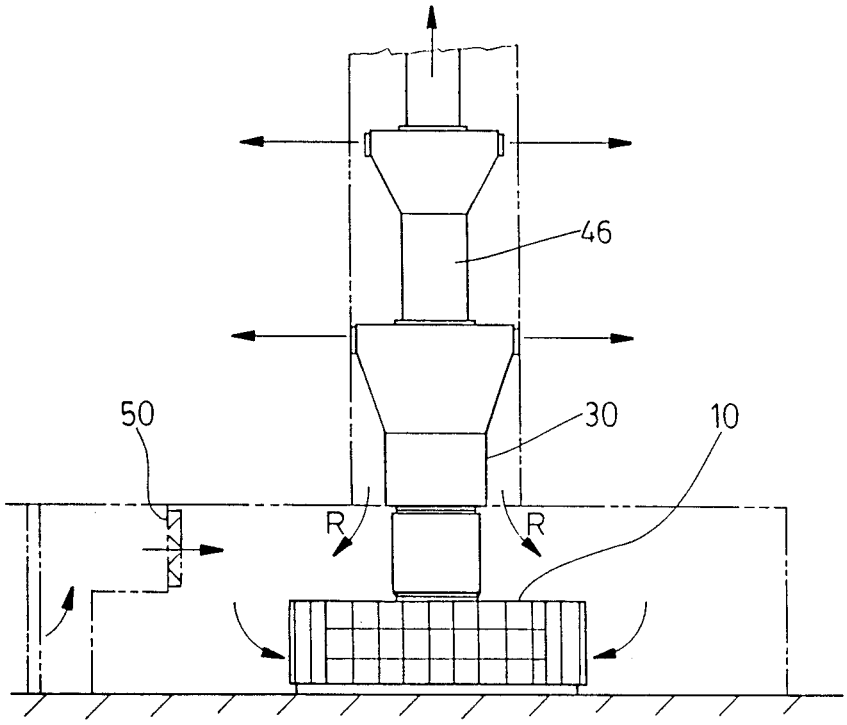
FIG. 2 is a schematic view in elevation of an air distribution system having two or more branch take-off air flow devices.
Figure 3:
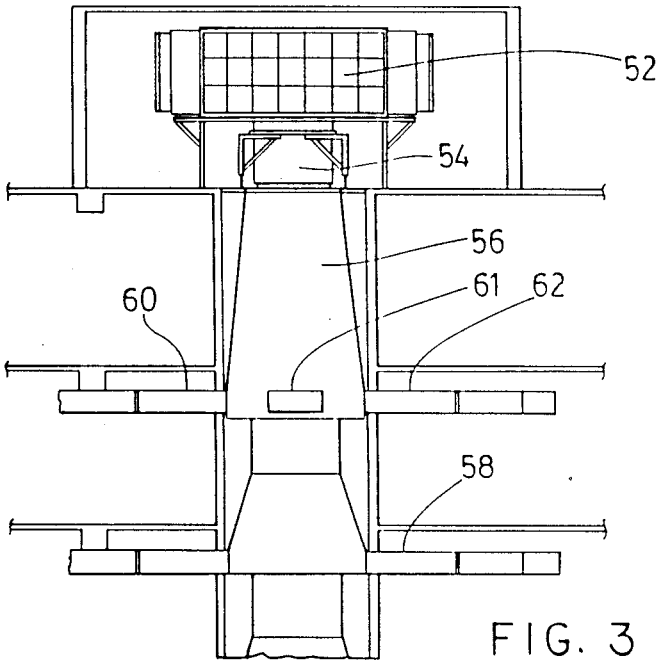
FIG. 3 is an elevational view of a vertical down-blast air distribution system showing two branch take-off air flow devices.

The bottom portion of a vertical up-blast air distribution system is illustrated in FIG. 1. The illustrated system has an air inlet silencer indicated generally at 10 having four rectangular inlets 12 adjacent to each other and arranged at 90 degrees to one another. The inlet silencer feeds air to an axial fan 14 having a round central hub 16 and a round fan housing 18 which, in the illustrated version, is mounted on wheels or rollers 20 so that the fan unit can be rolled out on roll-out rails 22 for maintenance or repair purposes. Preferably the fan 14 is of the type wherein the pitch of the vanes is controllable and there are an integral pitch actuator, pilot positioner and external blade pitch indicator of known construction. The impeller blades of the fan are preferably of aerofoil section cast aluminium alloy and are mounted on thrust bearings with grease retaining features. The fan is provided with a motor 24 which can be an electrical squirrel-cage induction type. The entire fan assembly is mounted on spring isolators 26 in order to isolate fan vibration. The fan unit has a round air outlet 28 which is connected by a suitable flexible connection to a first branch take-off air flow device 30 (hereinafter such air flow devices shall be referred to as SRT's which is an acronym for silencer/riser/take-off module). The first SRT 30 is located downstream from the axial fan 14 and, in the embodiment of FIG. 1, is located in the vertical shaft 32 in the region of the first floor level of the building indicated at 34. The air distribution system includes an output duct 36 located downstream of SRT 30 and typically this output duct comprises another SRT as illustrated in FIGS. 2 and 3. The air distribution system also includes branch ducts angularly offset (normally at a 90 degree angle) from the center axis of the fan 14 and the output duct 36. The branch ducts 38 illustrated in FIG. 1 feed fresh air to the first floor level 34 to the extent required by the designer of the system. Return air is typically returned to the basement level through the annular passageway around the SRT's, which passageway is indicated at 40 for the first floor level and 42 for the second floor level.

With the inlet silencer 10 of FIG. 1, there are typically provided four filter sections 44 in order to filter the incoming air in a known manner. Also, if desired, cooling coils can be incorporated into the system by installing them vertically on each of the four open sides of the inlet silencer. As such cooling coils form no part of the present invention, further description of their construction is deemed unnecessary at this time.

FIG. 2 illustrates a second SRT mounted immediately above the first SRT 30. The second SRT by means of its take-off passageways feeds air to the second floor level of the building. The second SRT 46 and subsequent SRT's are similar to the initial SRT 30 except that there is typically no elongate air flow defining member or "bullet" 48 provided in the main air passageway extending through the SRT. The purpose and function of the air flow defining member 48 in the first SRT is described hereinafter but generally such a member is only required in the SRT located immediately downstream of the axial fan in order to provide smooth and efficient air flow therethrough and sound attenuation. Also illustrated in FIG. 2 is a wall opening or vent 50 located in the basement level of the building for permitting outside air to flow into the room containing the inlet silencer 10. This outside air mixes with the return air indicated by the arrows R.

FIG. 3 of the drawings illustrates an air distribution system wherein the inlet silencer 52 is located in the top floor of the building or on the roof. The illustrated system is a vertical down blast system wherein the fresh air flows downwardly from a axial fan 54 to an initial SRT 56 and then to a second SRT 58. The initial SRT 56 is connected to at least three branch ducts indicated at 60, 61 and 62. It will be appreciated by those skilled in the art that the number of branch ducts connected to each SRT can vary from a single branch duct only to as many as four or more.

The SRT's constructed in accordance with the invention are a combination of two major sections, the first being a static pressure regain section indicated at 80 in FIGS. 4 to 8 and a take-off section 82, one version of which is illustrated in FIGS. 9 to 12. The regain section 80 is connected to the take-off section and is located immediately upstream therefrom as indicated in FIG. 1. The construction of the regain section for the initial SRT 30 will now be described in detail with reference to FIGS. 4 to 8. It will be appreciated that the regain sections in the second and subsequent SRT's are of similar construction except that they generally do not have the central airflow defining member 48. The regain section 80 has an air passageway 84 extending the entire height of the section. This passageway has an input port 86 that is round and that has a size substantially the same as the fan outlet or input duct 28 (see FIG. 1). The air passageway has a rectangular output opening 88 which opens into the main passageway of the take-off section 82.

Figure 4:
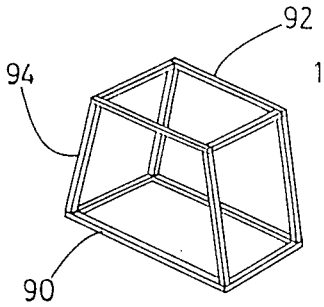
FIG. 4 is a perspective view of a tubular frame for a static regain section.
Figure 5:
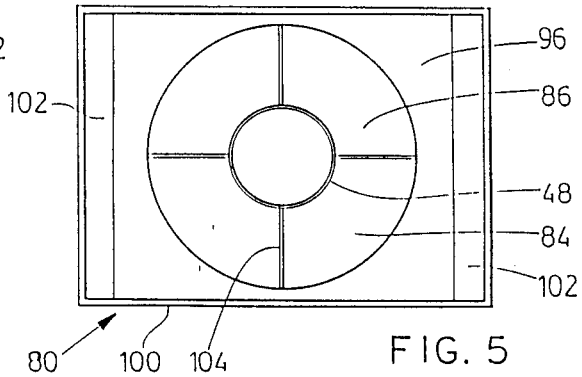
FIG. 5 is a top view of a static pressure regain section for a branch take-off air flow device.
Figure 6:
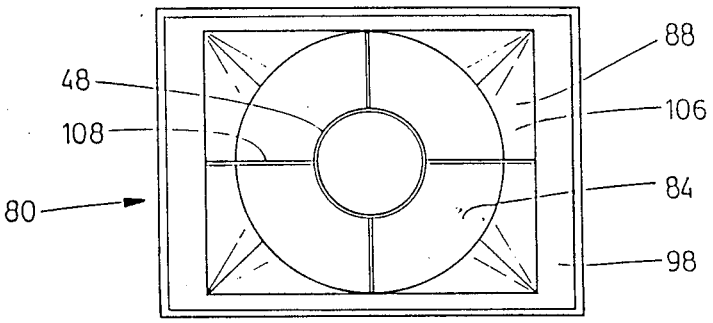
FIG. 6 is a bottom view of the regain section of FIG. 5.
Figure 7:
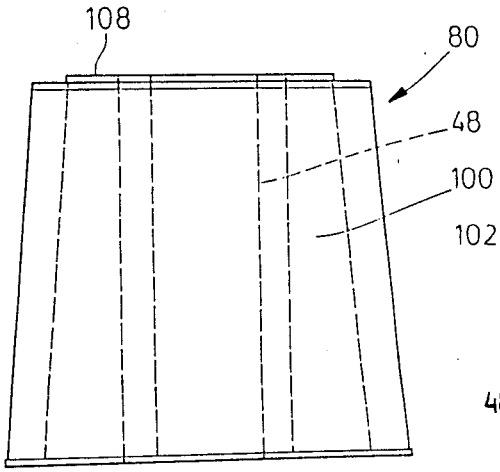
FIGS. 7 and 8 are long side and short side views respectively of the regain section of FIG. 5.
Figure 8:
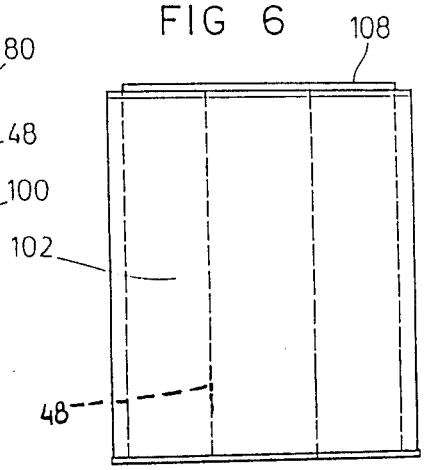

The regain section 80 can be constructed using a tubular frame structure such as that shown in FIG. 4. This frame structure includes a bottom rectangular frame 90 and a smaller upper rectangular frame 92. These two frames are connected by four upright and sloping frame members 94. Mounted on the upper rectangular frame 92 and welded thereto is a top panel 96 cut to form the circular input port. Welded to the bottom rectangular frame 90 is a steel bottom panel 98 cut to form the rectangular output opening 88. On the outside of the regain section, extending between the rectangular frames are steel side panels 100 as well as steel end panels 102.

The central air flow defining member or bullet 48 is secured centrally by four radially extending connecting panels or ribs 104. Also extending between the top and bottom panels are inside wall panels 106 which are shaped to provide a smooth and gradual transition from the circular input port 86 to the rectangular output opening 88. A suitable connecting flange 108 extends upwardly a short distance from the top panel 96 and extends around the circular port 86.

The regain section 80 is adapted to transfer most of the input air flow to a central passageway of the take-off section where it passes to the main output port and a minor portion of the air flow is transferred to the take-off passageways. With the described configuration of the regain section, the air flow velocity decreases as the flow passes from the input port 86 to the take-off section, resulting in a static pressure gain. It will be particularly noted that the air flow defining member 48 has a generally round transverse cross-section with a maximum diameter preferably equal to the diameter of the hub 16 of the fan. This provides a smooth, straight flow of air from the fan into the air distribution system and helps in the reduction of noise creation in the fan region. As explained hereinafter in connection with the take-off section, both the air flow defining member 48 and the walls surrounding the air passageway are filled with acoustically absorbing material and the metal sheet forming the member 48 and the sheets forming the inside walls of the regain section are perforated for sound attenuation. In other words, the metal surfaces in contact with the air flow are all perforated.

Turning now to the construction of the take-off section 82 shown in FIGS. 9 to 12, the illustrated version has three take-off passageways 110 to 112. Also, the aforementioned air flow defining member 48 extends through this take-off section being a continuation of the member extending through the regain section. Again, it will be appreciated that in the second and subsequent SRT's there is no air flow defining member 48 in the take-off section.

Figure 13:
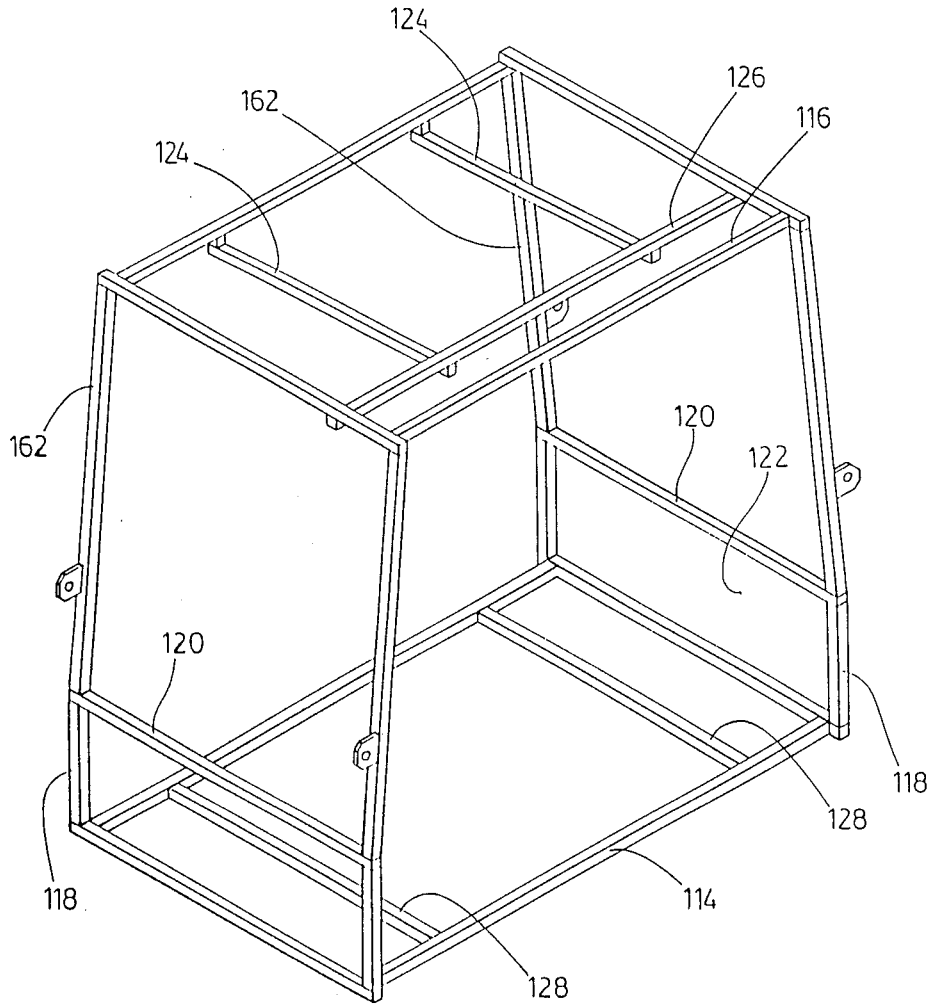
FIG. 13 is a perspective view of the tubular frame work for the take-off section shown in FIGS. 9 to 12.

FIG. 13 illustrates the tubular framework that can be employed to construct the take-off section 82. This framework comprises a large rectangular bottom frame 114 and a somewhat smaller upper rectangular frame 116. Extending vertically upwardly from the bottom frame 114 are four straight, short frame members 118 and pairs of these are connected by horizontal frame members 120. The rectangular areas 122 formed by the frame members 118 and 120 provide the locations for the rectangular output ports of take-off passageways 110 and 112. To provide support for the upper ends of the take-off passageway ducts, there are two parallel frame members 124 and a longer frame member 126 that is connected to the ends of members 124 and to the rectangular frame 116. Further support is provided by two parallel internal frame members 128 that are connected to the bottom frame 114. Connected to the upper frame 116 is a rectangular top panel 130 which defines a rectangular opening 132 having the same dimensions as the output opening 88 of the regain section.

The take-off section 82 includes a central passageway 134 through which the aforementioned air flow defining member extends. This central passageway has an output port 136 of a size substantially the same as an inlet of the output duct 36 (see FIG. 1). Preferably, a connecting flange 138 is provided at the output port to provide a means for connecting the adjoining duct work.

Figure 9:
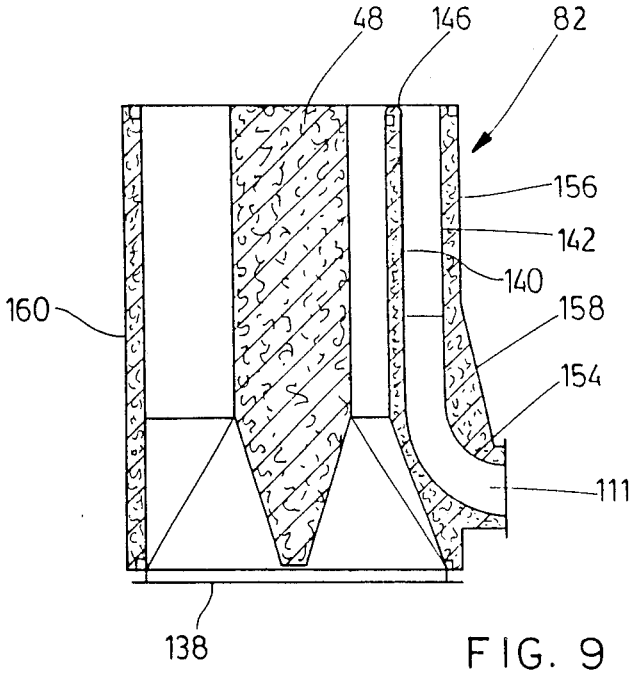
FIG. 9 is a cross-sectional view taken along the line IX—IX of FIG. 11 of a take-off section of an air flow device.
Figure 10:
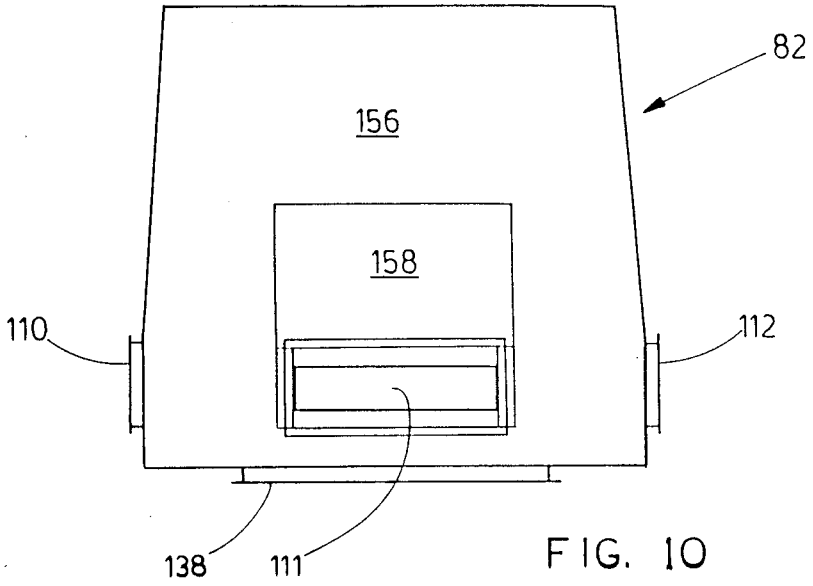
FIG. 10 is a side view of the take-off section of FIG. 9, which section has three take-off passageways.
Figure 11:
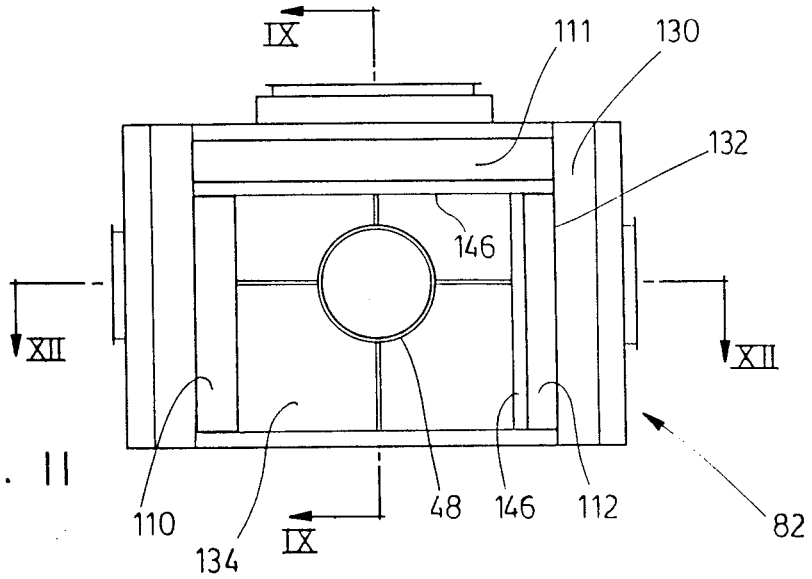
FIG. 11 is a top view of the take-off section of FIGS. 9 and 10.
Figure 12:
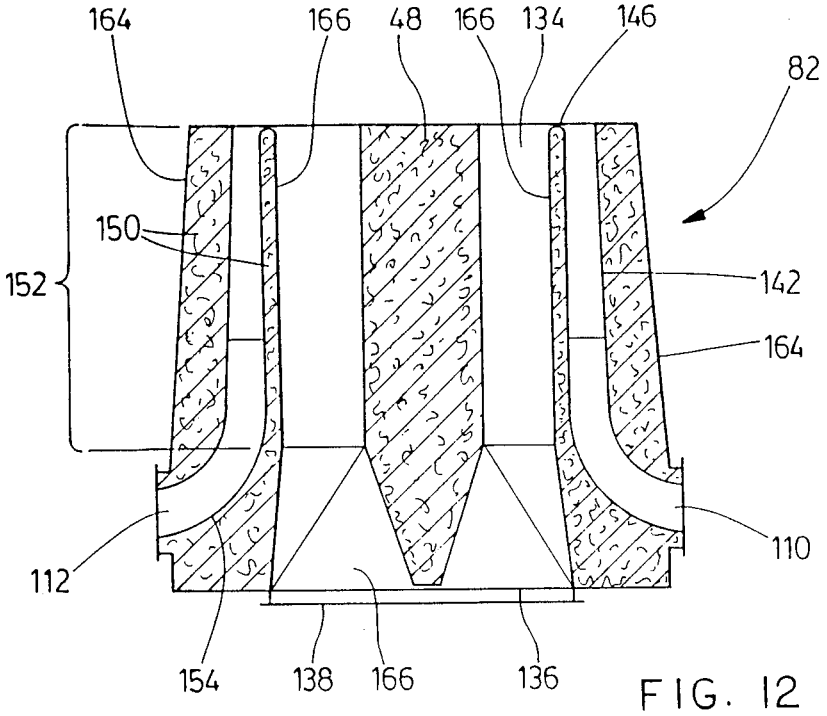
FIG. 12 is a cross-sectional elevation of the take-off section taken along the line XII—XII of FIG. 11.
Figure 14:
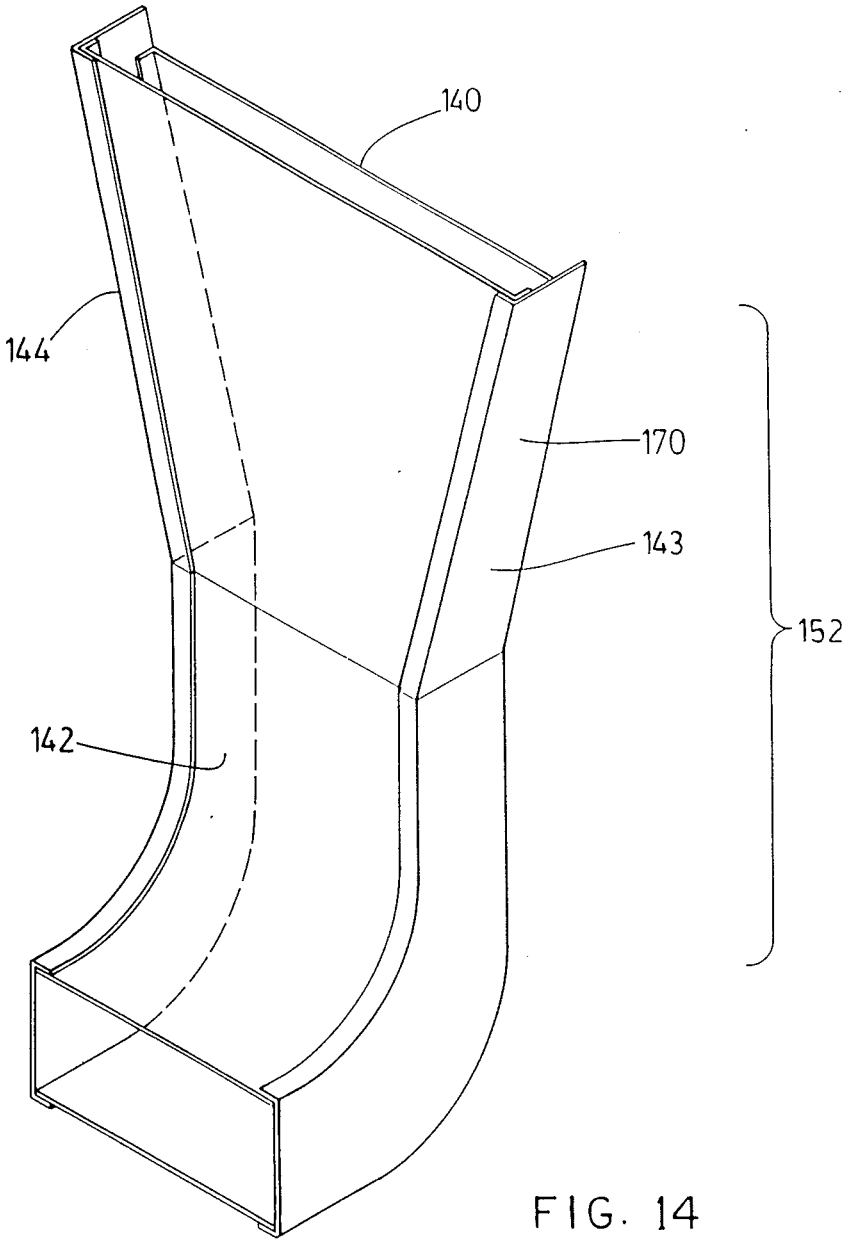
FIG. 14 is a perspective view illustrating the sheet metal construction of a single take-off passageway.

The preferred construction and cross-section of the sheet metal walls forming each take-off passageway is shown clearly in FIG. 14. Each of these take-off passageways is generally rectangular in transverse cross-section which makes them relatively easy to manufacture using standard sheet metal techniques. Each is defined by an inner wall 140 and an outer wall 142 as well as sidewalls 143 and 144 which connect the inner and outer walls. As shown in FIGS. 9 and 12, the inner wall preferably has a thick, rounded leading edge 146 located where the take-off passageway commences. It has been found that this type of leading edge provides improved noise reducing characteristics, particularly under a variety of air flow conditions and it is an improvement from a sound attenuating standpoint over a leading edge that is a thin flat sheet or sharply pointed. In a particularly perferred embodiment, the inner wall in the region of the leading edge has a thickness of about 3½ inches. This thickness permits the inner wall 140 to be insulated with sound absorbing material. Preferably both the inner and outer walls are insulated with this sound absorbing material 150 and preferably this material is covered by a perforated metal sheet i.e. mild steel or stainless steel, forming the surface of the wall adjacent to the air flow in the SRT. These perforations are indicated by the dash lines outlining the configuration of the sheets in FIGS. 10 and 13. The steel is perforated with circular openings so that preferably more than about 33% of the area is open. As indicated above, the preferred form of sound attenuating material is a loose fiber material having a density in the range of 0.8 to 1.2 pounds per cubic foot. The preferred material is a fiberglass mat with a special covering so as to provide zero erosion of the material at 6000 feet per minute air flow. Such material is sold under the brand name Knauf Ductliner M sold by Knauf Company of Shelbyville, Ind., U.S.A.

Also indicated in FIGS. 9 and 12 is the preferred configuration of each take-off passageway in axial cross-section. Each passageway preferably has a relatively long straight first portion 152 and an outwardly curving second portion 154 downstream from the first portion. As explained in greater detail hereinafter, the second portion 154 preferably has a gradually increasing transverse cross-sectional area in the direction of air flow.

The take-off section includes a front side panel 156 having suitable connecting flanges for securing the panel to the framework of FIG. 13. There is also an outwardly sloping rectangular panel 158 connected to the panel 156 and positioned directly above the output end of the take-off passageway 111. A vertical rear panel 160 is connected to the two upright frame members 162 and the interconnecting frame that forms part of the upper frame 116. There are also narrower side panels 164 that are connected to the tubular framework of FIG. 13 and that extend between the front and rear side panels. There are also of course internal perforated panels 166 which define the surface of the central passageway in the take-off section. These panels connect at the top to the aforementioned leading edge 146 on those sides of the device that have take-off passageways.

It should also be noted from FIG. 14 that the straight first portion 152 of each of these passageways initial tapers inwardly at the sides of the passageway in the region indicated at 170, that is the sheet metal side panels 143 and 144 converge in the downwardly direction. Prior to the commencement of the curved second portion, the passageway becomes uniform in width, that is the side panels 143 and 144 extend in parallel planes. By this relatively simple arrangement, the width of the take-off passageway is gradually reduced to the width of the branch duct.

In order to design a preferred form of branch take-off air flow device constructed in accordance with the invention, reference will be made to FIGS. 15 to 18 which indicate certain dimensions of the air flow device that are either known or given or can be calculated as indicated below. For purposes of the present discussion, the following lettering will be used to indicate the stated dimension or quantity:

| LETTER | DESCRIPTION OF QUANTITY OR DIMENSION INDICATED BY THE LETTER |
|---|---|
| $D_1$ | Fan Outer DIA. |
| $D_2$ | Fan Hub DIA. |

-continued

| LETTER | DESCRIPTION OF QUANTITY OR DIMENSION INDICATED BY THE LETTER |
|---|---|
| $Q_F$ | System Volume Flow |
| $Q_1$ | Branch #1 Flow |
| $Q_2$ | Branch #2 Flow |
| $H_1$ | Branch #1 Exit Height |
| $L_1$ | Branch #1 Exit Width |
| $H_2$ | Branch #2 Exit Height |
| $L_2$ | Branch #2 Exit Width |

The system volume flow is a given quantity that is based on the size of the building, the number of floors and the rate of fresh air flow into each floor desired by the architect or engineer. The flow of air required through each branch duct is also a known quantity being based on similar factors and calculations. The size of the fan used in the system including the outer diameter and the hub diameter $D_1$ and $D_2$ are also known quantities once the desired fan unit has been selected based on the total volume of air flow required for the system. The heights and widths of the branch ducts are also known quantities as each branch must satisfy certain maximum dimension requirements of the building and must be able to provide the required air flow. With these known quantities it is then possible to calculate the velocity of flow wherein $V_F$ is the velocity of air flow at the fan exit, $V_1$ is the velocity of air flow in branch duct 1 and $V_2$ is the velocity of air flow in branch No. 2.

$$V_F = \frac{Q_F}{\pi/4(D_1^2 - D_2^2)}$$

$$V_1 = \frac{Q_1}{H_1 \times L_1}$$

$$V_2 = \frac{Q_2}{H_2 \times L_2}$$

Upon calculating these velocities, it is then necessary to check the following:

$$V_F \leqq 1.3 \times \text{MAX}\,[V_1, V_2]$$

If this equation is not satisfied then it is necessary to request or obtain new inputs. It is then necessary to set the value $V_I$ which is the air velocity at the top or upstream end of the take-off section 82. $V_I$ is set by the following equation in order to ensure optimum regain of between 60% and 80% in the flow of air downwards in the air flow device.

$$V_I = 1.5 \times \text{MIN}\,[V_1, V_2]$$

One should then check the following:

$$\frac{V_F}{V_I} < 1.3$$

If this requirement is satisfied then $V_I$ is redefined as follows:

$$V_I = \frac{V_F}{1.3}$$

Figure 18:
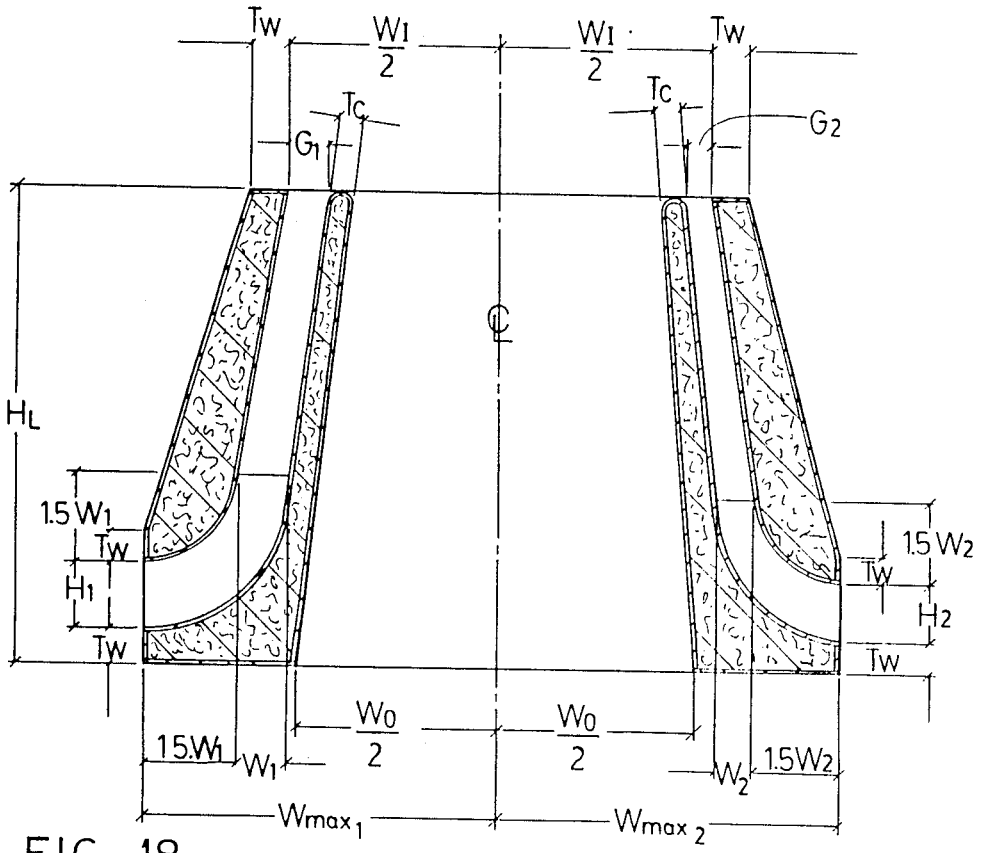
FIG. 18 is a sectional detail of the take-off section illustrating the significant dimensions of the take-off passageways.

The following equations are then solved wherein the variable Z is such that $0.75 \leqq Z \leqq 1.334$ and G is the width of the take-off passageway as shown in FIG. 18 and W is the width of the take-off passageway at the bottom of the straight section.

$$W_I = \left\{ Z \left[ \frac{Q_F}{V_I} + \frac{D_2^2 \pi}{4} \right] \right\}^{\frac{1}{2}}$$

$$L_I = \frac{W_I}{Z}$$

$$G_1 = \frac{Q_1}{L_I \times V_I} \qquad Tw = 4 \text{ inches}$$

$$Tc = 3.5 \text{ inches}$$

$$G_2 = \frac{Q_2}{L_I \times V_I}$$

$$W_1 = H_1 \times \frac{V_1}{V_I}$$

$$W_2 = H_2 \times \frac{V_2}{V_I}$$

The following equations are then solved for each of the two branches:

FOR BRANCH #1

$$h_{c1} = H_1 \times \left( 1 + 1.5 \frac{V_1}{V_I} \right)$$

$$h_{s1} = \frac{(L_I - L_1)}{2} \times \tan 60°$$

FOR BRANCH #2

$$h_{c2} = H_2 \times \left( 1 + 1.5 \left( \frac{V_2}{V_I} \right) \right)$$

$$h_{s2} = \frac{(L_I - L_2)}{2} \times \tan 60°$$

In these equations for each branch, $h_c$ represents the height of the curved portion of the take-off duct and $h_s$ represents the height of the straight portion of a take-off duct.

The total design height $H_L$ of the take-off section is determined by the following equation:

$$H_{L1} = [\text{MAX}\{(h_{c1} + h_{s1}), (h_{c2} + h_{s2})\} + Tw]$$

This equation is based on the fact that the designer selects the maximum of the two calculated heights for use in the actual unit.

Figure 15:
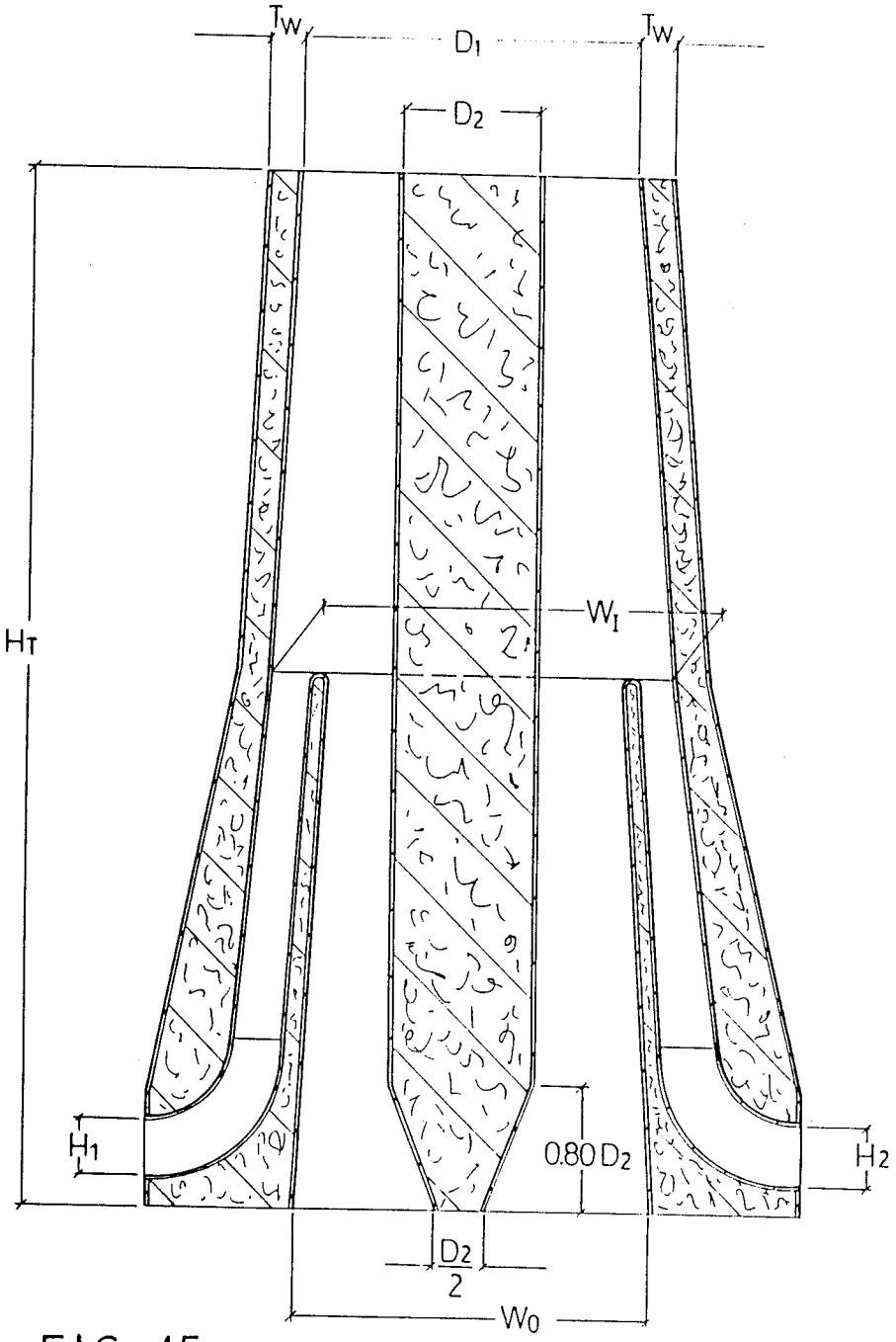
FIG. 15 is a schematic illustration in cross-section of a branch take-off air flow device constructed in accordance with the invention.

It is now possible to solve the following four equations with the dimension $W_{max}$ being indicated in FIG. 18 and the dimension $W_0$ being the width of the central air passageway at the outlet (see FIG. 15).

$$\Delta_1 = \frac{W_0}{2} - \left[ \frac{W_I}{2} - (Tc + G_1) \right]$$

$$W_{max1} = \left[ \frac{W_0}{2} - \frac{(h_{c1} + Tw)\,\Delta_1}{H_L} \right] + Tc + 2.5\,H_1 \left( \frac{V_1}{V_I} \right)$$

-continued $$\Delta_2 = \frac{W_0}{2} - \left[ \frac{W_I}{2} - (Tc + G_2) \right]$$

$$W_{max2} = \left[ \frac{W_0}{2} - \frac{(h_{c2} + Tw)\,\Delta_2}{H_L} \right] + Tc + 2.5\,H_2 \left( \frac{V_2}{V_I} \right)$$

In these equations the Δ symbol represents an intermediate parameter used to determine the maximum width of the take-off unit.

The following H values are then calculated to determine the actual $H_L$ to be used in constructing the take-off section:

$$H_{L2} = \frac{(L_I - L_O)}{0.8}$$

$$H_{L3} = \frac{\{W_{o/2} - [W_{I/2} - (G_1 + Tc)]\}}{0.176}$$

$$H_{L4} = \frac{\{W_{o/2} - [W_{I/2} - (G_2 - Tc)]\}}{0.176}$$

$$H_{L5} = \left( \frac{A}{\pi} \right)^{\frac{1}{2}}$$

$$\text{where } A' = L_I \times [W_I - (G_1 + G_2 + 2\,Tc)] - \frac{\pi D_2^2}{4}$$

Figure 16:
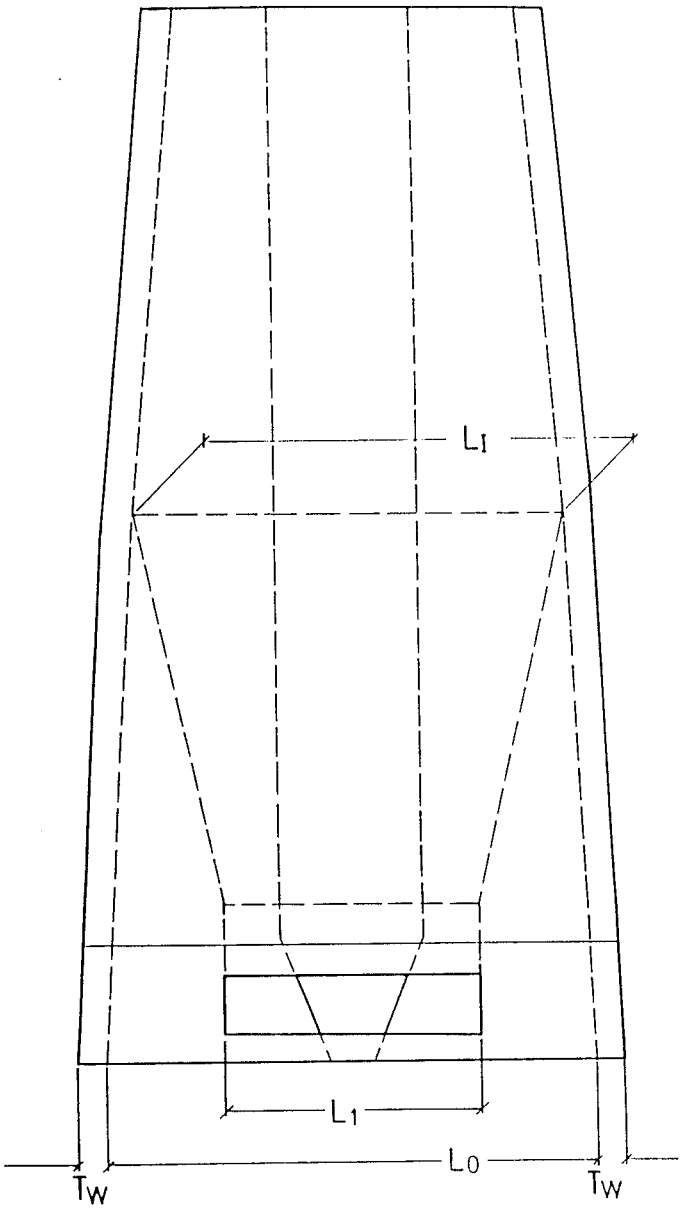
FIG. 16 is a schematic illustration in elevation of a branch take-off air flow device with one only of the branches being illustrated in dashed lines.

The dimensions $L_I$ and $L_O$ are shown in FIG. 16 of the drawings. The dimensions $W_O$ and $W_I$, $G_1$ and $T_c$ are shown in FIG. 18 as is the dimension $G_2$ used in the third equation above. The dimension $D_2$ is the diameter of the fan hub as indicated above. The value $H_L$ is set as the maximum of the five calculated values $H_{L1}$, $H_{L2}$, $H_{L3}$, $H_{L4}$ and $H_{L5}$. The following design checks should also be run to determine that the indicated requirement is met and, if any of these requirements are not satisfied, new input figures should be used:

$$1 \leqq \frac{V_I}{V_1} \leqq 1.5$$

$$1 \leqq \frac{V_I}{V_2} < 1.5$$

$$0.75 \leqq \frac{W_o}{L_o} \leqq 1.334$$

$$G_1 > Tc$$

$$G_2 > Tc$$

$$\frac{W_I}{2} - \left[ G_1 + 2Tc + \frac{D_2}{2} \right] \geqq 0$$

$$\frac{W_I}{2} - \left[ G_2 + 2Tc + \frac{D_2}{2} \right] \geqq 0$$

$$1 \leqq AR \leqq 1.4$$

where $$AR = \frac{L_o \times W_o}{\{[L_I \times (W_I - (G_1 + G_2 + 2Tc))] - \frac{\pi D_2^2}{4}}$$

Figure 17:
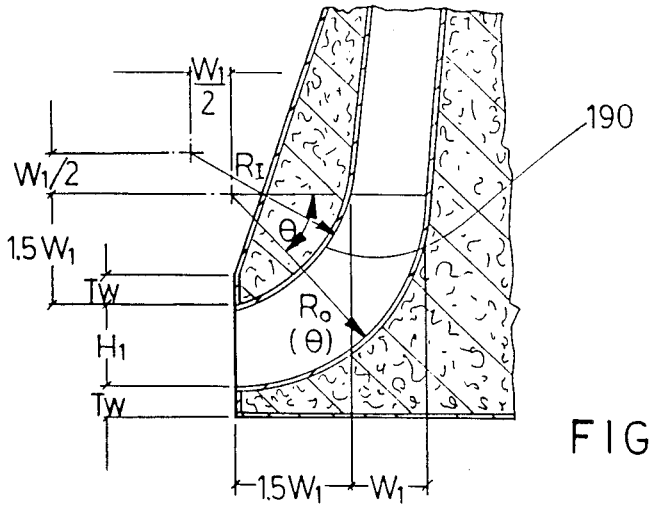
FIG. 17 is a schematic sectional detail of the curved portion of a take-off passageway.

Referring now to the curvature of the downstream portion of the take-off passageway, which curvature is detailed in FIG. 17 of the drawings, it will be noted that the inner surface 190 of the outer wall has a uniform radius of curvature $R_I$ which curvature is equal to 1.5 times the width $W_1$ of the respective take-off passageway at the downstream end of the straight first portion 152, $W_1$ being measured perpendicular to the center line of the take-off section (see FIG. 18). Because of its uniform curvature, this inner surface is relatively easy to construct. The outside radius $R_O$ identified in FIG. 17 varies along the curved surface and is determined by the following equation:

$$R_O(\theta)=2.5\ W_1+\theta/90^\circ\times H_1-W_1$$

It will be appreciated that the above equations and calculations have been provided for an SRT having two take-off passageways but similar equations and criteria can be used to design and construct an SRT having three or four take-off passageways.

Preferably the exterior walls of the SRT should have a thickness of at least 4 inches so that they will contain adequate acoustic fill to provide good low frequency sound attenuation. The preferred thickness for the inner walls forming the take-off passageways is about 3½ inches. If the dimension of the inner wall exceeds this thickness by a significant amount, there will be an unnecessary interference with the smooth flow of air through the unit.

It will be understood that the function of the upstream end of the SRT, that is the regain section, is to carefully slow the air flow thereby reducing energy losses and to change the transverse cross-section from circular to rectangular. The shape transition simplifies the design and reduces the cost of the downstream portion of the SRT, that is the take-off section. It will be further noted that all of the air flow paths have a smoothly increasing cross-sectional area again reducing the energy losses in the system.

In addition to providing a smooth air flow in the region of the fan discharge, the air flow defining member or bullet 48 in the initial SRT because it is filled with sound absorbing material improves the acoustic absorbtion of this SRT without an undue increase in energy loss.

With respect to the rounded leading edge of each inner wall at the commencement of the take-off passageway, this edge has the advantage of increasing the acoustic absorption of both the take-off passageway and the central passageway and, in addition, it provides improved off-design aerodynamic performance. In practice, in commercial buildings the distribution of air changes with the daily solar cycle and with changes in office space use. The rounded leading edge may provide lower energy losses (as compared to known designs) during times when the flow distribution has significantly deviated from the design conditions.

It will be appreciated by those skilled in the art that various modifications and changes can be made to the described branch take-off air flow devices without departing from the spirit and scope of this invention. Accordingly, all such modifications and changes as fall within the scope of the appended claims are intended to be part of this invention.

We therefore claim:

1. A branch take-off airflow device for use in an air distribution system that includes coaxial input and output ducts and one or more branch ducts angularly offset from said input and output ducts, said device comprising:

a static pressure regain section having an air passageway with an input port of a size substantially the same as the outlet of said input duct and an output opening, a take-off section including a central passageway and one or more take-off passageways, said central passageway having an output port of a size substantially the same as an inlet of said output duct, each of said one or more take-off passageways being generally rectangular in transverse cross-section and defined by inner and outer walls with said outer wall being a continuation of a wall defining said output opening of said regain section, wherein said inner wall has a thick, rounded leading edge where the take-off passageway commences; and an elongate airflow defining member located centrally in both said passageway of said regain section and said central passageway of said take-off section and extending in the axial direction, said member having a generally round transverse cross-section, which is substantially uniform in said regain section, the diameter of said member in said take-off section being equal to or less than its uniform diameter in the regain section;

wherein said airflow defining member extends axially past said rounded leading edge where the take-off passageway commences.

2. A branch take-off airflow device according to claim 1 wherein said inner wall is insulated with sound absorbing material that extends to said leading edge.

3. A branch take-off airflow device according to claim 2 wherein both said inner and outer walls are insulated with sound absorbing material which is covered by a perforated metal sheet on the surfaces of the walls defining the take-off passageway which are in contact with the airflow through the passageway.

4. A branch take-off airflow device according to claim 1 wherein each take-off passageway has a relatively long straight first portion and an outwardly curving second portion downstream from said first portion, said second portion having a gradually increasing transverse cross-sectional area in the direction of airflow.

5. A branch take-off airflow device according to claim 2 wherein said inner wall in the region of said leading edge has a thickness of about 3.5 inches or more.

6. A branch take-off airflow device for use in an air distribution system downstream of an axial fan having a central hub and a fan housing with a round air outlet, said system including an output duct located downstream of said device and one or more branch ducts angularly offset from the center axis of said fan and said output duct, said device comprising:

a static pressure regain section having an air passageway extending therethrough, said passageway having an inlet substantially the same in size as said round air outlet of the fan, a take-off section including a central air passageway extending therethrough and one or more take-off passageways, said central passageway having an output port of a size substantially the same as an inlet of said output duct, and and elongate airflow defining member located centrally in both said passageway of said regain section and said central passageway of said take-off section and extending in the axial direction, said member having a generally round transverse cross-section with a maximum diameter equal to or less than the diameter of the hub of said fan, said airflow defining member being generally cylindrical in said regain section and extending axially past an inlet or inlets of aid one or more take-off passageways.

7. An airflow device according to claim 6 wherein said airflow defining member has a metal exterior skin that is perforated with numerous holes distributed over its surface, said member being filled with sound absorbing material surrounded by said skin.

8. An airflow device according to claim 6 wherein said inlet of the regain section is round and the transverse cross-section of said air passageway in said regain section changes smoothly and gradually from circular to rectangular along the length of the passageway.

9. An airflow device according to claim 7 wherein each take-off passageway is defined by inner and outer walls with the outer wall being a continuation of a wall defining one side of the regain section at the downstream end thereof, both said inner and outer walls containing sound absorbing material which is covered with perforated metal sheet on surfaces that are in contact with the airflow during use of the device.

* * * * *